US007393223B1

(12) United States Patent
Koda

(10) Patent No.: US 7,393,223 B1
(45) Date of Patent: Jul. 1, 2008

(54) ELECTRICAL MOUNTING CONNECTOR FOR A BI-PIN FLUORESCENT BULB

(76) Inventor: Kojiro Koda, 4-32-8, Kamiikebukuro, Toshima-ku, Tokyo (JP)

( * ) Notice: Subject to any disclaimer, the term of this patent is extended or adjusted under 35 U.S.C. 154(b) by 0 days.

(21) Appl. No.: 11/731,156

(22) Filed: Mar. 31, 2007

(51) Int. Cl.
*H01R 29/00* (2006.01)

(52) U.S. Cl. ..... 439/168; 439/375

(58) Field of Classification Search ..... 439/182, 439/220, 242, 375, 488, 699.2
See application file for complete search history.

(56) References Cited

U.S. PATENT DOCUMENTS

| | | | | |
|---|---|---|---|---|
| 5,340,327 | A | 8/1994 | Koda | |
| 5,904,415 | A * | 5/1999 | Robertson et al. | 362/260 |
| 2005/0037661 | A1 * | 2/2005 | Tanacan et al. | 439/488 |

* cited by examiner

*Primary Examiner*—Tho Dac Ta
*Assistant Examiner*—Travis Chambers
(74) *Attorney, Agent, or Firm*—Wagner, Anderson & Bright, LLP; Roy L Anderson

(57) ABSTRACT

An electrical mounting connector for a bi-pin fluorescent bulb has a lamp holder with two terminals and a cap with two pin guiding openings that snaps into the lamp holder such that two pins held in the two pin guiding openings will be held in contact with the two pin-shaped over a substantial portion of the pins along a parallel length of the pins. An alignment marking is provided on the lamp holder and a visual inspection point (such as a hole) is provided on the cap that compliment one another to provide a visual indication of when the lamp holder and the cap are properly assembled together. A drain is formed by one or more slots in the lamp holder to drain a space between the lamp holder and the cap accessed through pin guiding openings when the lamp holder and the cap are properly assembled together. A bi-pin fluorescent bulb is mounted to two lamp holders by inserting the pins of each of its ends into a cap to form an assembly and then sliding the assembly into the two lamp holders so that each pin comes into contact with a terminal in a direction parallel to the bi-pin fluorescent bulb.

20 Claims, 3 Drawing Sheets

ELECTRICAL MOUNTING CONNECTOR FOR A BI-PIN FLUORESCENT BULB

FIELD OF THE INVENTION

The present invention is in the field of electrical mounting connectors for bi-pin fluorescent bulbs.

BACKGROUND OF THE INVENTION

Bi-pin fluorescent bulbs are in common use throughout the United States and common in standard and varying lengths. Each bulb has two ends, and each end has two pins used to connect the bulb to an electrical source.

Bi-pin fluorescent bulbs are often used in fluorescent lighting fixtures where the bulbs are inserted into the lighting fixtures by aligning the pins so that they pass through a slit opening. The bi-pins on one end of the bulb is inserted first, and then the other end follows the same way, pushing these pins into the slits and in between two electrical terminals of the lighting fixtures. This is a common procedure for inserting fluorescent bulbs into fluorescent lighting fixtures.

The present invention is directed to commercial lighting displays and other situations where fluorescent lighting may be used in connection with counters and other displays and where increased surface contact with the electrical terminals of the lighting fixtures is of prime importance. In addition, there have been incidents of fires caused by such lighting displays, and it is highly desirable to develop improved connectors that lessen the likelihood or occurrence of such fires.

SUMMARY OF THE INVENTION

The present invention is generally directed to an electrical mounting connector for a bi-pin fluorescent bulb having a lamp holder with two terminals and a cap with two pin guiding openings that snaps into the lamp holder such that two pins held in the two pin guiding openings will be held in contact with the two terminals over a substantial portion of the pins along a parallel length of the pins.

In a first, separate group of aspects of the present invention, an alignment marking is provided on the lamp holder and a visual inspection point (such as a hole) is provided on the cap that compliment one another to provide a visual indication of when the lamp holder and the cap are properly assembled together.

In other, separate aspects of the present invention, a drain is formed by one or more slots in the lamp holder to drain a space between the lamp holder and the cap accessed through pin guiding openings when the lamp holder and the cap are properly assembled together. The pin guiding openings may be a pin guiding hole with a diameter less than a pin diameter in communication with slits.

In other, separate aspects of the present invention, a bi-pin fluorescent bulb is mounted to two lamp holders by inserting the pins of each of its ends into a cap to form an assembly and then sliding the assembly into the two lamp holders so that each pin comes into contact with a terminal over a substantial portion of the pin in a direction parallel to the bi-pin fluorescent bulb.

Accordingly, it is a primary object of the present invention to provide more surface contact between bi-pins of a lamp with terminals to thereby provide an improved electrical mounting connector for bi-pin fluorescent bulbs.

This and further objects and advantages will be apparent to those skilled in the art in connection with the drawings and the detailed description of the preferred embodiment set forth below.

BRIEF DESCRIPTION OF THE DRAWINGS

FIG. 4A illustrates cap 20 as it begins to be inserted into cap lamp holder receptacle 30 of cap 20 while

DETAILED DESCRIPTION OF THE INVENTION

Figure 1:
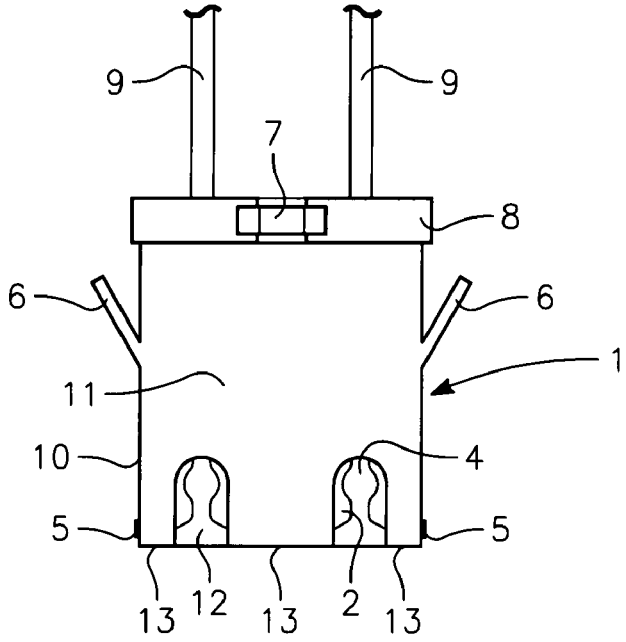
FIG. 1 is a top planar view of lamp holder 1.
Figure 1A:
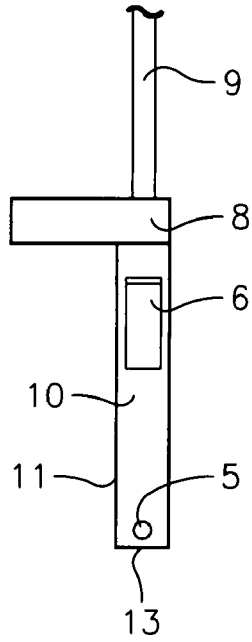
FIG. 1A is a side planar view of lamp holder 1.
Figure 1B:
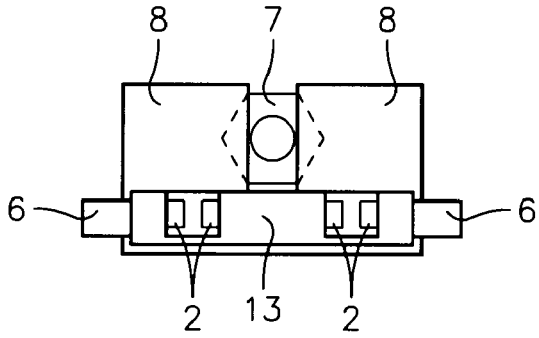
FIG. 1B is a front wall planar view of lamp holder 1.
Figure 1C:
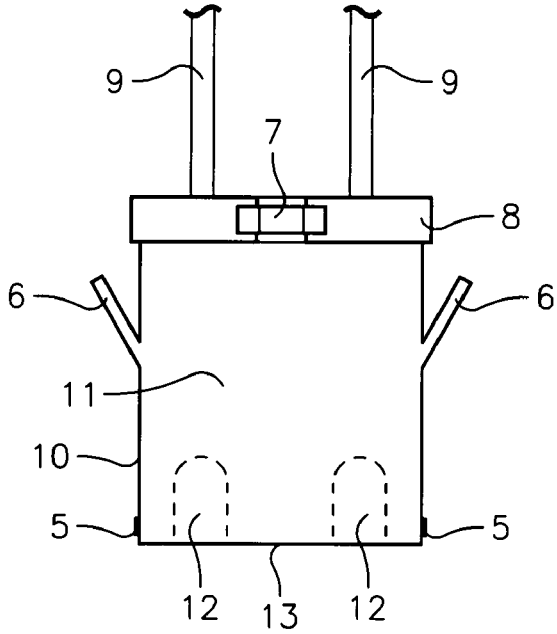
FIG. 1C is a bottom planar view of lamp holder 1.

The present invention will now be discussed in connection with a preferred embodiment shown in FIGS. 1-5.

In the Figures and the following more detailed description, numerals indicate various features of the invention, with like numerals referring to like features throughout both the drawings and the description. Although the Figures are described in greater detail below, the following is a glossary of the elements identified in the Figures.

1 lamp holder
2 terminal
3 pin shape of terminal 2
4 insertion hole
5 visual marker
6 snapping flange
7 mounting nut
8 nut holding wall
9 wire
10 lamp holder side wall
11 lamp holder front wall
12 lamp holder terminal back wall
13 lamp holder top walls
20 cap
21 pin guiding hole
22 pin hole slits
23 cap lamp holder wall
24 circular wall
25 visual marker hole
26 bottom drain slot
27 drain (when assembled with lamp holder 1 in cap 20)
28 clear tubing retainer lip
30 cap lamp holder receptacle
31 cap lamp holder receptacle back wall
32 cap lamp holder receptacle angled side walls
33 cap lamp holder receptacle bottom wall
40 pin (from a bi-pin bulb)

Figure 5:
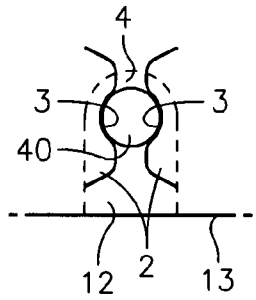
FIG. 5 is a cross section cutaway depiction of an assembled connector in accordance with the present invention showing contact of the terminals with one pin of a bi-pin fluorescent bulb.
Figure 5A:
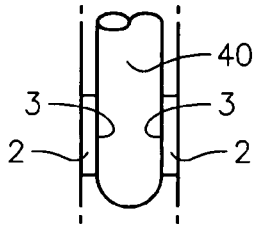
FIG. 5A is a cross-section taken along line 5-5 of FIG. 5.

As shown in FIG. 1, a lamp holder 1 has two terminals 2 having a pin shape 3 inside insertion holes 4. The terminal itself is made of flexible metal electrically connected to wires 9 and is positioned perpendicular to terminal back wall 12. The pin shape 3 of the terminals is slightly smaller than the size of an actual shape of a pin from a lighting fixture so that insertion of the pin into insertion hole 4 will cause the terminals to slightly expand outwardly in the general direction of lamp holder side wall 10. When pins from a bi-pin fluorescent lamp are inserted into terminals 2 they will be inserted so that they are perpendicular to lamp holder terminal back wall 12 and so that they fit into are firmly held in contact with pin shapes 3 of terminals 2 as shown in FIGS. 5 and 5A. In addition, terminals 2 are constructed so that they provide a large contact area with the bi-pins, instead of a typical knife-point type of contact. In essence, as shown in FIGS. 5 and 5A, terminals 2 encase a substantial portion of the pin along a significant parallel length of the pin. This large and secure contact area creates a much more secure contact and, it is believed, may reduce the possibility of arcing that might otherwise occur in knife-point or lesser contacts with traditional terminals.

Figure 2:
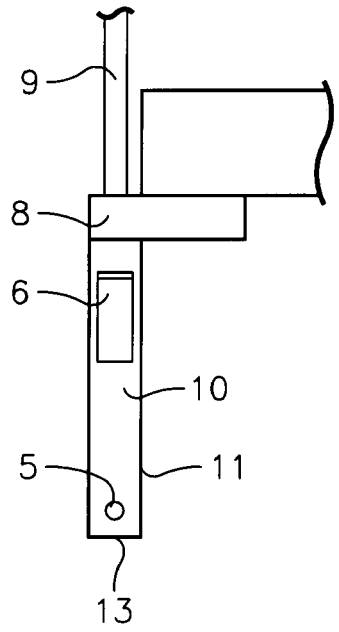
FIG. 2 shows lamp holder 1 mounted to a structure.

Lamp holder 1 has a nut holding wall 8 for holding a mounting nut 7 for mounting lamp holder 1 in place to a shelf, cabinet, wall or other structure as shown in FIG. 2. The wires 9 from lamp holder 1 are themselves then fed to a load structure, and three sets of wires 9 from three different lamp holders 1 can themselves be combined to a single electrical connection such as described in another application filed concurrently herewith, entitled "Electrical Connection for High Humidity and Low Temperature Environments," Appl. Ser. No. 11/731,155, the disclosure of which is specifically incorporated herein by reference. To mount a light, two lamp holders 1 are themselves mounted to a structure at an appropriate width, then a bi-pin lamp is mounted to two caps 20, and then the lamp and two cap assembly is snapped into the two lamp holders 1 already mounted. Additionally, a clear tube (not shown) can be mounted outside the bi-pin lamp and fitted over the outside of circular wall 24 of two caps 20 between two clear tubing retaining lips 28.

Figure 3:
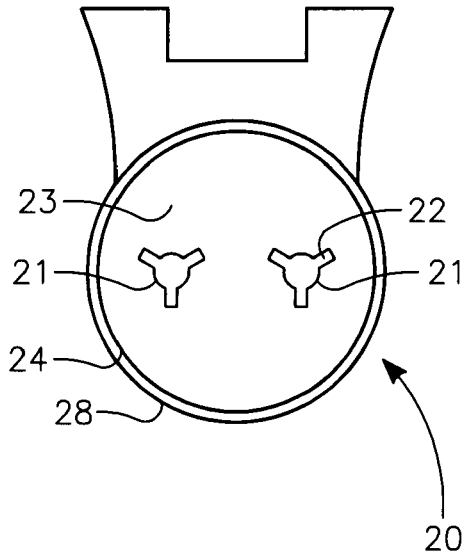
FIG. 3 is a front planar view of a cap 20 looking into its pin guiding holes 21.
Figure 3A:
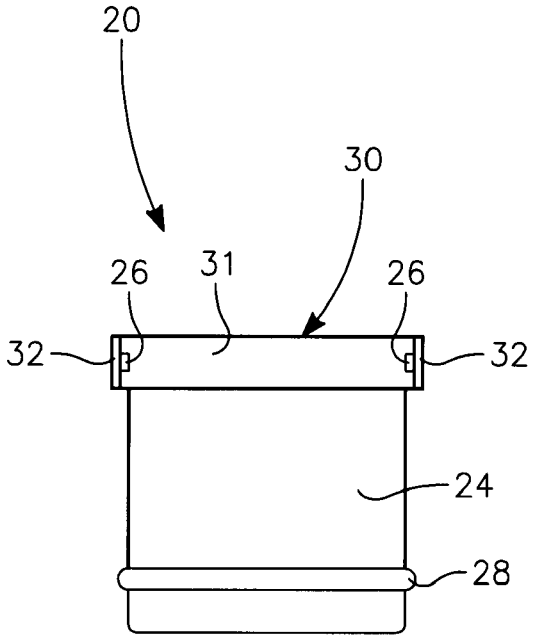
FIG. 3A is a side planar view of cap 20 looking into its cap lamp holder receptacle 30.
Figure 3B:
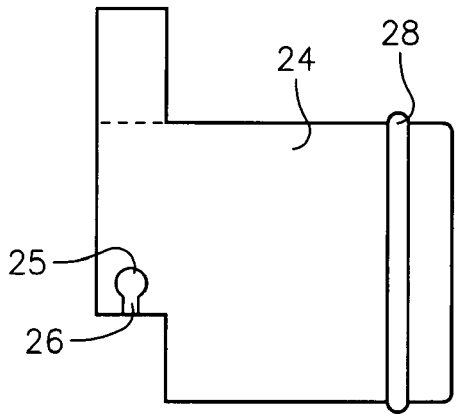
FIG. 3B is a side planar view of cap 20.

Cap 20, as shown in FIG. 3, has two pin guiding holes 21 in cap lamp holder wall 23. Each pin guiding hole 21 is slightly smaller than the diameter of a pin of a bi-pin fluorescent lamp and has three pin hole slits 22 that allow the pin of the bi-pin fluorescent lamp to be inserted through the hole 21 and slits 22 and protrude into cap lamp holder receptacle 30 (which is part of cap 20) where they enter insertion hole 4 and can come into contact with terminal 2 of lamp holder 1 when cap 20 is snapped into place with lamp holder 1. As a pin is inserted into a guiding hole 21 slits 22 cause the flaps of material between them to protrude out in the direction the pin is being pushed and thereby squeeze the pin which also helps to prevent the cap from slipping off the end of the bi-pin lamp when it is not being held a lamp holder. Cap 20 also has circular wall 24 that supports and fits around an end of a bi-pin fluorescent lamp (not shown) when the cap is assembled to such lamp. Cap lamp holder receptacle 30 has two angled side walls 32, a back wall 31 and a bottom wall 33. The two angled side walls 32 of cap lamp holder receptacle 30 are configured so as to allow snapping flanges 6 of lamp holder 1 to snap into place as cap 20 is urged into connection with lamp holder 1 as is shown in moving from the position of FIG. 4A to the position of FIG. 4B.

Figure 4A:
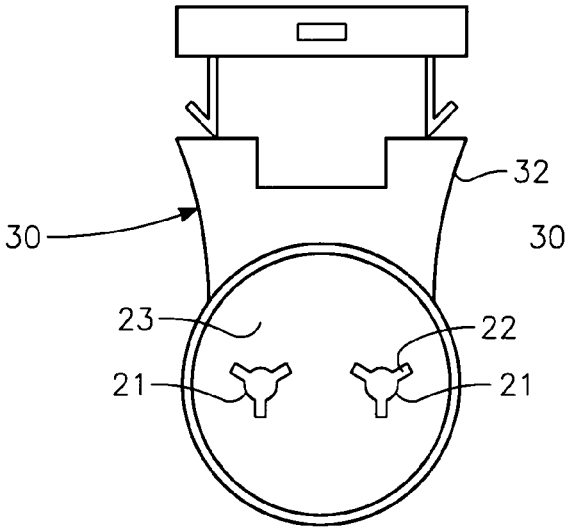
Figure 4B:
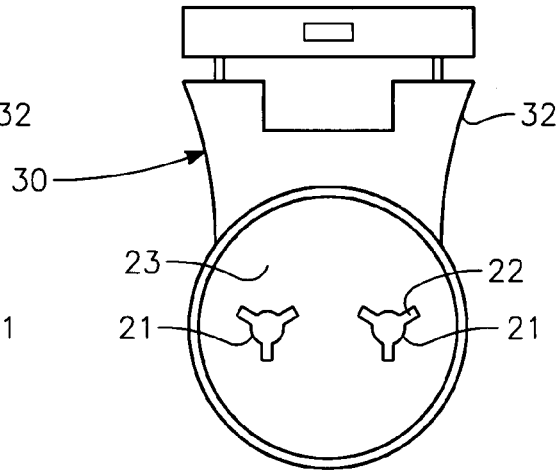
FIG. 4B illustrates cap 20 completely inserted.
Figure 4C:
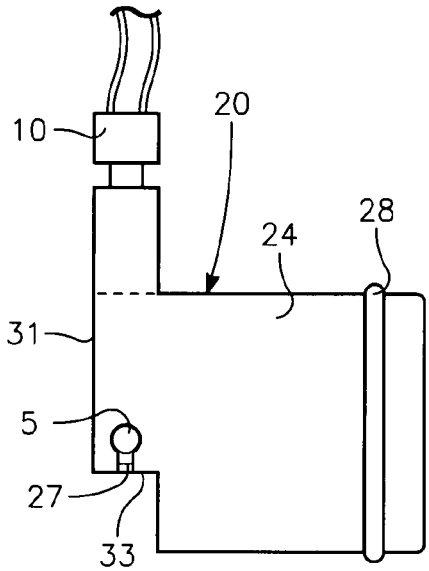
FIG. 4C is a side planar view showing cap 20 completely inserted into lamp holder 1.

Cap lamp holder receptacle 30 has visual marker hole 25 and bottom drain slot 26 extending upwardly from cap lamp holder receptacle bottom wall 33 along cap lamp holder receptacle angled side walls 32. When cap 20 is correctly inserted into lamp holder 1 visual marker 5 on lamp holder 1 should be visible through visual marker hole 25 (which could also be a window, but that would be more expensive and less desirable) and a drain 27 should be created (as shown in FIG. 4C) for any moisture that might otherwise accumulate in the bottom of cap lamp holder receptacle 30. Visual markers 5 can also be made to slightly stand out from lamp holder side wall 10 so that they must, in essence, snap into visual marker hole 25, thereby also providing additional retaining support when cap 20 is correctly fitted into lamp holder 1.

A key advantage of the present invention is its ease of use and stability of holding bi-pin fluorescent lamps. It is often difficult to determine when bi-pin fluorescent lamps are firmly held in contact with their terminals, and this can be a bigger problem when the light is being used in cabinets or hard to reach places. In the instant invention the bi-pin fluorescent lamp pins are held in place in pin guiding hole 21 and pin hole slits 22 and then snapped into pin shape 3 of terminals 2 in a direction parallel to the length of the lamp where they are held such that a substantial portion of the pin along a significant parallel length of the pin is in firm contact with the terminals and it is easy to determine the pins are correctly aligned from the visual indication of visual marker 5 being aligned in visual marker hole 25.

While the invention has been described herein with reference to certain preferred embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. An electrical mounting connector for a bi-pin fluorescent bulb, comprising:

a lamp holder with two pin-shaped terminals and a lamp holder snapping element; and a cap with two pin guiding openings and a cap snapping element to secure a connection between the cap and the lamp holder such that two pins held in the two pin guiding openings will be herd in contact with the two terminals over a substantial portion of the pins along a significant length of the pins;

wherein the lamp holder snapping element and the cap snapping element will snap together without requiring the orientation of the two pins held in the two pin guiding openings to rotate relative to the two pin-shaped terminals of the lamp.

2. The electrical mounting connector of claim 1, further comprising a second lamp holder snapping element and a second cap snapping element that snap together.

3. The electrical mounting connector of claim 1, further comprising:

at least one alignment marking on the lamp holder; and a visual inspection point on the cap;

wherein the alignment marking and the visual inspection point will compliment each other so as to provide a visual indication of when the lamp holder and the cap are properly assembled together.

4. The electrical mounting connector of claim 3, wherein the visual inspection point is an opening and the visual indication is visibility of the visual inspection point through the opening.

5. The electrical mounting connector of claim 4, wherein the lamp holder snapping element is the opening and the cap snapping element is the visual inspection point.

6. The electrical mounting connector of claim 5, wherein the drain is located below the opening.

7. The electrical mounting connector of claim 1, further comprising:

a drain in the cap.

8. The electrical mounting connector of claim 7, wherein the drain is formed by at least one slot in the lamp holder that drains a space between the lamp holder and the cap.

9. The electrical mounting connector of claim 8, wherein the space can be accessed through the two pin guiding openings when the lamp holder and the cap are properly assembled together.

10. The electrical mounting connector of claim 9, wherein each of the two pin guiding openings is comprised of a pin guiding hole with a diameter less than a pin diameter in communication with a plurality of slits.

11. A method of mounting a bi-pin fluorescent bulb, comprising the steps of:

mounting two lamp holders, each of which has two terminals, to a desired location;

inserting two pins of a first end of the bulb into two pin guiding openings of a first cap;

inserting two pins of a second end of the bulb into two pin guiding openings of a second cap to form an assembly; and sliding the assembly into the two lamp holders so that each pin of the first and second ends of the bulb comes into contact with one terminal and is held in a pin guiding opening over a substantial portion of the pin along a parallel length of the pin;

wherein the assembly is secured in the lamp holder without requiring the orientation of the assembly to rotate relative to the two lamp holders as the assembly is slid into the two lamp holders.

12. The method of claim 11, further comprising the step of confirming that the assembly is properly mounted by checking a visual inspection point at each of the two lamp holders, the visual inspection point providing a visual indication of when a cap is properly mounted with its lamp holder.

13. The method of claim 11 wherein the assembly is snapped into the two lamp holders by activating snapping means contained in the two lamp holders and the first and second caps.

14. An electrical mounting connector for a bi-pin fluorescent bulb, comprising:

a lamp holder with two pin-shaped terminals; and a cap with two drains and two pin guiding openings that snaps into the lamp holder such that two pins held in the two pin guiding openings will be held in contact with the two terminals over a substantial portion of the pins along a significant length of the pins;

wherein the two drains are formed by two slots in the cap that drain a space between the lamp holder and the cap; and wherein the space can be accessed through the two pin guiding openings when the lamp holder and the cap are properly assembled together.

15. The electrical mounting connector of claim 14, wherein each of the two pin guiding openings is comprised of a pin guiding hole with a diameter less than a pin diameter in communication with a plurality of slits.

16. A fluorescent bulb lighting assembly, comprising:

a bi-pin fluorescent bulb having a first and a second end, each end having two pins;

a first and a second lamp holder, each having two terminals and two snapping male members, and each mounted to create a preselected distance between themselves; and a first and a second cap mounted to the first and second ends of the bi-pin fluorescent bulb to create an assembly held in the first and second lamp holders, each of the first and second caps having two pin guiding openings through which pins of the bulb have been asserted, two snapping female members and two drains;

wherein the assembly is inserted into the first and second lamp holders such that two pins held in the two pin guiding openings will be held in contact with the two terminals and the assembly is snapped into the first and second lamp holders without requiring the orientation of the two pins held in the two pin guiding openings to rotate relative to the two pin-shaped terminals of the lamp.

17. The fluorescent bulb lighting assembly of claim 16, wherein the two drains are in a plane that is substantially perpendicular to a second plane containing the first and second ends of the bi-pin fluorescent bulb.

18. The fluorescent bulb lighting assembly of claim 16, wherein the two drains drain a space between the lamp holder and the cap and the space can be accessed through the two pin guiding openings.

19. The fluorescent bulb lighting assembly of claim 16, wherein each of the two snapping female members is comprised of an opening.

20. The fluorescent bulb lighting assembly of claim 19, wherein two visual inspection points are provided by the two snapping male members snapped into the two snapping female members when the lamp holder and the cap are properly assembled together.

* * * * *